US007604119B2

(12) United States Patent
Schott et al.

(10) Patent No.: US 7,604,119 B2
(45) Date of Patent: Oct. 20, 2009

(54) PROTECTIVE PACKAGE FOR CUSHIONING OBJECT WITH CIRCULAR CONTOUR

(75) Inventors: Guy Schott, Ligny En Barrois (FR); Marie-Amélie Clerc, Lyons (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 518 days.

(21) Appl. No.: 10/535,429

(22) PCT Filed: Nov. 13, 2003

(86) PCT No.: PCT/FR03/03369

§ 371 (c)(1),
(2), (4) Date: Jan. 5, 2006

(87) PCT Pub. No.: WO2004/050488

PCT Pub. Date: Jun. 17, 2004

(65) Prior Publication Data

US 2006/0131198 A1 Jun. 22, 2006

(30) Foreign Application Priority Data

Nov. 20, 2002 (FR) ..... 02 14555

(51) Int. Cl.
*B65D 85/30* (2006.01)
*B65D 85/48* (2006.01)

(52) U.S. Cl. ..... 206/454; 206/485; 206/784

(58) Field of Classification Search ..... 206/454, 206/449, 775, 783, 485, 485.1, 784, 316.1, 206/5; 229/126, 149
See application file for complete search history.

(56) References Cited

U.S. PATENT DOCUMENTS

| | | | | | |
|---|---|---|---|---|---|
| 2,846,132 | A * | 8/1958 | Carpenter | 229/188 |
| 3,741,380 | A * | 6/1973 | Carney | 206/783 |
| 5,385,238 | A * | 1/1995 | Lancaster et al. | 206/594 |
| 5,522,504 | A * | 6/1996 | Levi | 206/424 |
| 5,529,187 | A * | 6/1996 | DeNola | 206/449 |
| 5,829,587 | A * | 11/1998 | Saiki et al. | 206/327 |
| 5,884,767 | A * | 3/1999 | Peng | 206/485 |
| 6,685,026 | B1 * | 2/2004 | Hanna | 206/586 |
| 6,997,323 | B2 * | 2/2006 | Maresh et al. | 206/592 |
| 7,097,042 | B2 * | 8/2006 | Hsu | 206/751 |

FOREIGN PATENT DOCUMENTS

| | | | |
|---|---|---|---|
| DE | 26 36 454 | * | 2/1978 |
| DE | 93 07 318 | * | 7/1993 |
| DE | 44 14 131 | * | 10/1995 |
| EP | 0 693 428 | * | 1/1996 |
| FR | 2 610 601 | * | 8/1988 |
| WO | WO 94 24004 | * | 10/1994 |

* cited by examiner

*Primary Examiner*—Mickey Yu
*Assistant Examiner*—Steven A. Reynolds
(74) *Attorney, Agent, or Firm*—Young & Thompson

(57) ABSTRACT

A protective and cushioning package (1) includes a base wall (2), two boxes (3), two flaps (4, 5), a device for maintaining the boxes (3) and the flaps (4, 5) in raised position; and for each box (3), an outer side wall (100), and intermediate wall (11) and an inner side wall (13) form a triangular profile linked by an articulation (14, 52) to the base wall (2) and at least one cushioning tab (20, 21) is arranged in an opening (15) provided in the box (3) by being attached to the box (3) solely by one end opposite the base wall (2).

22 Claims, 4 Drawing Sheets

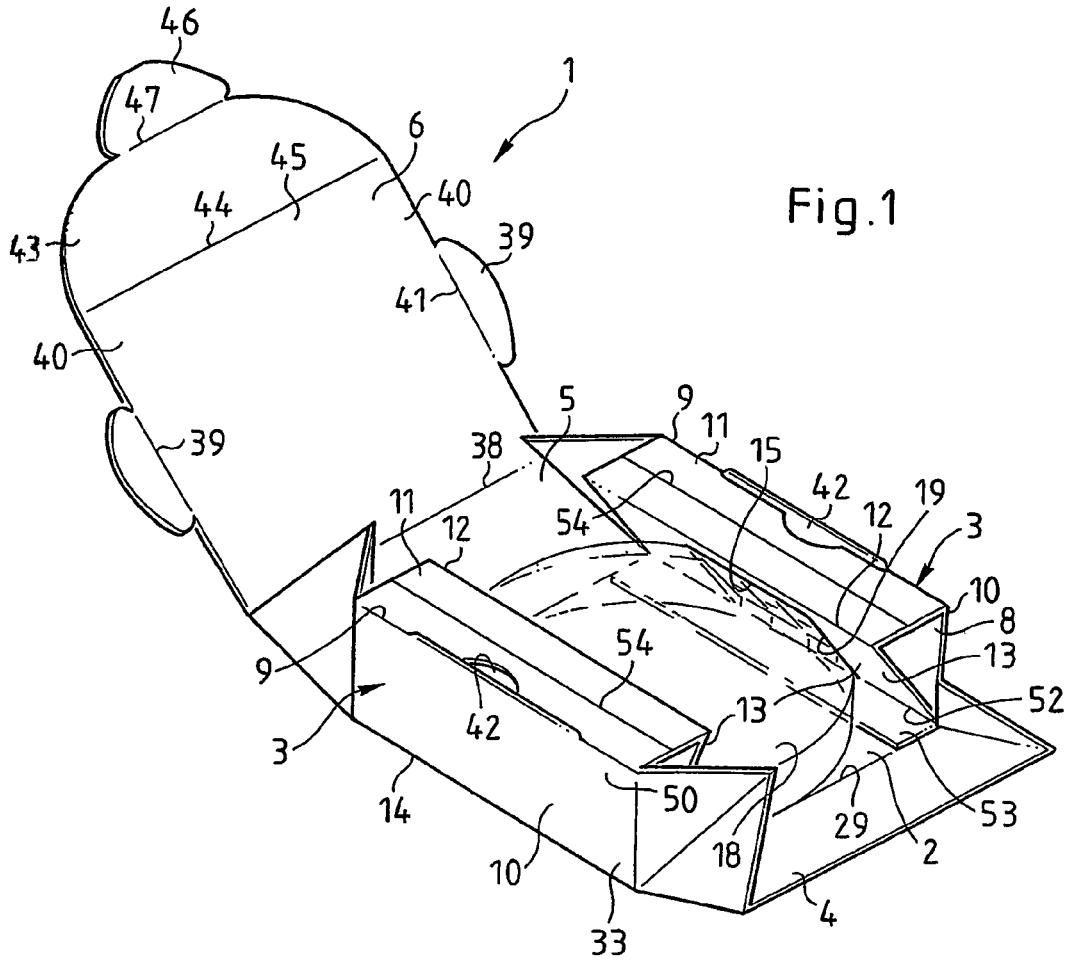
Fig.1
Fig.2
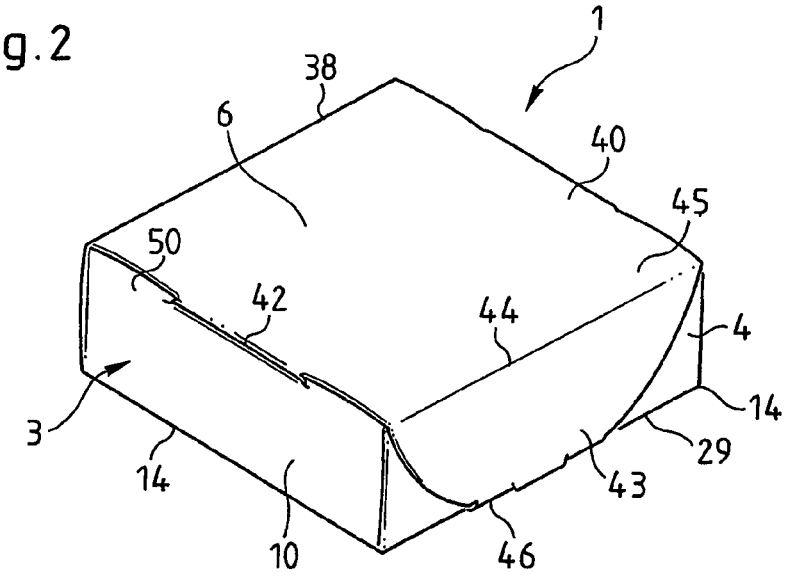

PROTECTIVE PACKAGE FOR CUSHIONING OBJECT WITH CIRCULAR CONTOUR

The invention relates to packaging for protecting and locating circular contour objects, and more specifically objects whose size and shape are comparable to those of a finished or semifinished eyeglass lens.

BACKGROUND OF THE INVENTION

A semifinished eyeglass lens is a lens of which only the convex face is finished (machined) in the process of mass production.

The manufacturer ships this kind of lens to a prescription laboratory which machines the concave face as a function of the requirements of the wearer.

When shipping the lens, it is vital to locate the lens to protect the finished face by preventing it coming into contact with anything, especially in the case of an organic material lens, which scratches very easily.

In the case of a finished lens, on the other hand, both the concave and convex faces are finished in the process of mass production.

The manufacturer ships the lens to the optician, who trims it as a function of the shape of the frame selected by the wearer and morphological parameters specific to the wearer (interpupillary distance, position of the pupils relative to the rims of the frame).

Once again, it is important to protect the faces of the lens because they are finished (i.e. machined and usually carrying treatment layers such as antiabrasion, antireflection and antisoiling layers, for example).

DESCRIPTION OF THE RELATED ART

Packaging of the above type is known in the art.

French patent application No. FR-2 703 654 describes a pull-out packaging for eyeglass lenses consisting of an external envelope and a receptacle, the latter including a bottom panel and two box-section rims articulated in the manner of a deformable parallelogram, a cut-out being formed in each box-section rim for the at least partial insertion of the eyeglass lens.

The receptacle of the above pull-out packaging receives the eyeglass lens on its bottom panel and in the aforementioned cut-outs, and is then inserted into the external envelope, the combination forming a box suitable for transportation.

This packaging is satisfactory in respect of fulfilling the intended function.

The invention nevertheless aims to improve it, in particular with regard to locating the lens.

SUMMARY OF THE INVENTION

To this end, a first object of the invention relates to packaging for protecting and locating a circular contour object such as an eyeglass lens, the packaging including:

a bottom panel;

two box-sections each including an external lateral panel and an internal lateral panel that includes an opening for at least partial insertion of the object, each box-section being attached by an articulation to the bottom panel along a respective one of two opposite edges, each box-section being adapted to assume a folded down position in which the external lateral panel is in line with the bottom panel and a raised position in which the external lateral panel upstands relative to the bottom panel;

two flaps each attached by an articulation to the bottom panel along a respective one of two opposite edges adjacent the box-sections, each flap being adapted to assume a folded down position in which it is in line with the bottom panel and a raised position in which the flap upstands relative to the bottom panel, against the longitudinal ends of the box-sections; and means for maintaining the box-sections and the flaps in the raised position;

characterized in that, for each box-section, said external lateral panel has a first end connected by an articulation to the bottom panel, a second end connected by an articulation to a first end of an intermediate panel, the latter also including a second end connected by an articulation to a first end of said internal lateral panel, the latter also including a second end connected by an articulation to the bottom panel along the articulation between the first end of the external lateral panel and the bottom panel, and in that at least one locating tongue is disposed in the opening and attached to the internal lateral panel only by an end opposite the bottom panel.

Thus the packaging of the invention enables optimum location and transportation of objects of different shapes and thicknesses. It is not necessary, for a given object diameter, to have different stock packaging specific to each type of circular object, thanks to the arrangement of the locating tongues and the box-sections, which provide retaining means adapted to be modulated.

The packaging may also be made in one piece, which facilitates and reduces the cost of fabricating it and using it in a production context.

The embodiments and additional features described hereinafter are preferably used by virtue of their qualities of simplicity and convenience.

In one embodiment, four locating tongues are disposed in each opening in the internal lateral panels, each locating tongue being independent of the others and attached to the bottom panel at one end.

The locating tongues may include at least one transverse scoring line over their length.

In another embodiment, each box-section is formed in one piece with the bottom panel by a rectangular panel connected by a first scoring line to the edge of the bottom panel, said rectangular panel including a second scoring line delimiting the external lateral panel, a third scoring line delimiting the intermediate panel, a fourth scoring line delimiting the internal lateral panel, and said rectangular panel extending beyond the fourth scoring line by way of a fixing flap fastened to the bottom panel so that the fourth scoring line is juxtaposed to the first scoring line.

Also, the intermediate panel may include a longitudinal scoring line, which may be disposed substantially along the longitudinal median line of the intermediate panel.

Moreover, the width of the external lateral panel may be substantially equal to the width of the internal lateral panel.

In another embodiment, the means for holding the box-sections and the flaps in the raised position include means associated with the flaps and with the box-sections to hold the box-sections in the raised position when the flaps are in the raised position and means for holding the flaps facing each other against the box-sections.

The means for holding the box-sections and the flaps in the raised position may include a closure panel articulated to the free edge of one of the flaps, this closure panel including attachment means to the box-sections and to the opposite flap so as to be able to assume a closure position in which it is parallel to the bottom panel and positioned against the box-sections and the free edge of the opposite flap when the latter are in the raised position.

The closure panel may include, beyond a scoring line and starting from its end opposite the flap to which it is articulated, a fold-down panel adapted to be superposed on the opposite flap when the closure panel is in the closure position.

Said attachment means may comprise attachment tongues projecting from the edges of the closure panel, the box-sections and the opposite flap including notches adapted to cooperate with the attachment tongues.

Finally, the flaps may each be attached to the adjacent longitudinal ends of the box-sections by two gussets.

Another aspect of the invention is a sheet material packaging blank characterized in that it comprises:

- a bottom panel;
- two external lateral panels connected by a scoring line to two opposite edges of the bottom panel;
- two flaps each connected by a scoring line to a respective one of the other two edges opposite the bottom panel;
- two intermediate panels connected by a scoring line to each of the opposite edges of the bottom panel of the two external lateral panels;
- two internal lateral panels each connected by a scoring line to a respective one of said intermediate panels at the edge thereof opposite the external lateral panel, each internal lateral panel being extended, in the direction away from the intermediate panel, by a fixing flap, the internal lateral panels further including a cut-out delimiting at least one tongue remaining attached to the rest of the panel by one of its ends;
- a closure panel with dimensions substantially equal to those of the bottom panel and connected by a scoring line to an edge opposite the bottom panel of one of the flaps.

The width of the lateral external panel and the width of the lateral internal panel of the packaging blank may be substantially equal.

In one embodiment, the external lateral panels and the flaps are connected in pairs at their ends adjacent the bottom panel by a gusset.

Similarly, the widths of each of the flaps and of each of the external lateral panels may be substantially equal.

A third aspect of the invention provides a method of packaging and locating a circular contour object employing packaging as defined hereinabove.

The above method provides for the selection of a combination of packaging and object to be packaged in which the bottom panel is a square whose side length is substantially equal to the diameter of the object.

BRIEF DESCRIPTION OF THE DRAWINGS

Other features and advantages of the invention will become apparent in the light of the following description of a preferred embodiment of the invention, provided by way of non-limiting example, the description being given with reference to the appended drawings, in which:

FIG. 1 is a perspective view of packaging of the invention when open, a located eyeglass lens being visible inside it;

FIG. 2 is a perspective view of the combination from FIG. 1 when the packaging is closed;

In the figures, the following conventions have been adopted for the sake of clarity:

- scoring lines are represented in thin chain-dotted line, for example the scoring line 44;
- linear notches formed in the material of the packaging are represented in thick solid line (for example the notch 55); and
- scoring lines formed by perforations are represented in thick dashed line (for example the scoring line 36).

Figure 6:
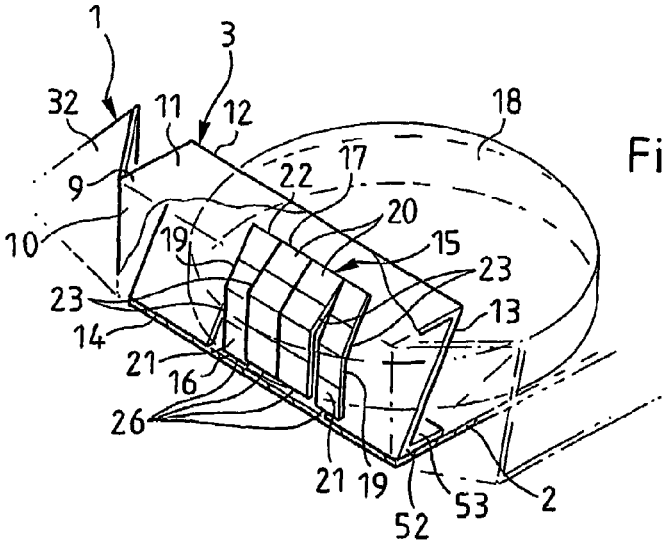
FIG. 6 is a partial perspective view representing an eyeglass lens in place and a box-section, a lateral external panel of the box-section being partially cut away to show the positions of its locating tongues.

However, the above conventions do not apply to the perspective views (FIGS. 1, 2, 6).

Figure 8:
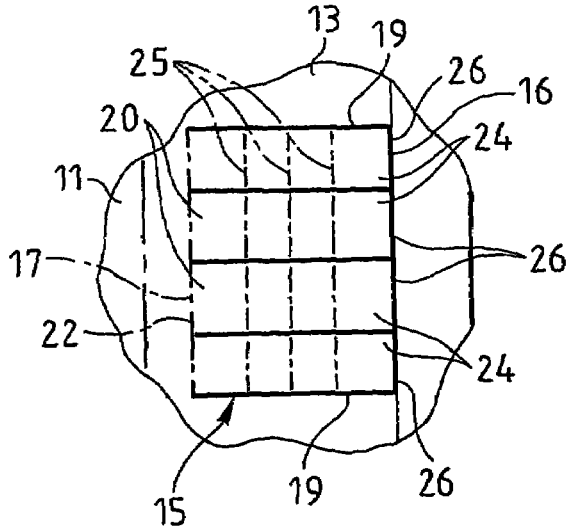
FIG. 8 is a detail view of the contents of the frame VIII in FIG. 7, specifically showing the locating tongues.

Furthermore, because of their small size in the other figures, the scoring lines on the locating tongues are shown in accordance with the above convention only in FIG. 8.

DETAILED DESCRIPTION OF THE PREFERRED EMBODIMENTS

Figure 3:
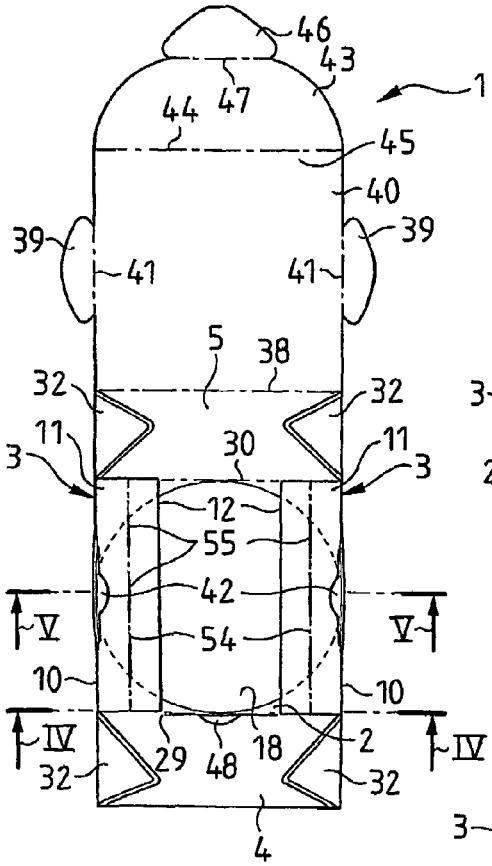
FIG. 3 is a top view of the packaging in the FIG. 1 position except that, to facilitate the explanation, its closure panel is in line with its bottom panel.

Referring to FIGS. 1 and 3, the packaging 1 includes a bottom panel 2, two lateral box-sections 3, two flaps 4, 5 and a closure panel 6.

The lateral box-sections 3 are disposed along two opposite edges 7 of the bottom panel 2; they are identical, parallel to each other and rest along their entire length on the bottom panel 2.

The box-sections 3 have a triangular section 8 (see FIG. 1) that stiffens the structure, which is made from a sheet material such as cardboard.

This structure 8 of each box-section 3 is obtained by connecting an external lateral panel 10 to an intermediate panel 11 along a scoring line 9, the intermediate panel 11 being itself connected to an internal lateral panel 13 along a scoring line 12. All three panels 10, 11 and 13 are rectangular in shape, each having a length that is preferably equal to that of the edge 7 of the bottom panel 2 to which the corresponding box-section 3 is attached.

Each box-section 3 is attached to the bottom panel 2 along a scoring line 14 common to the edge 7 of the bottom panel 2 and to one linear end of the box-section 3 corresponding to one apex of the triangle defined by the section 8 of the box-section 3.

Each box-section 3 is therefore formed by a triangular section 8 and is therefore mobile along the scoring line 14 between a folded down position in which the external lateral panel 10 is coplanar with the bottom panel 2 (FIG. 7) and a raised position in which the external lateral panel 10 is perpendicular to the bottom panel 2 (FIGS. 1, 3, 4 and 5).

Each box-section 3 has an opening 15 in its internal lateral panel 13. The opening 15 has a rectangular shape centered lengthwise of the internal lateral panel 13, one of the longer sides 16 delimiting it adjoining the bottom panel 2 and the other longer side 17 delimiting it adjoining the junction 12 of the internal lateral panel 13 and the intermediate panel 11. The opening 15 is intended to have an eyeglass lens 18 at least partially engaged in it when the box-sections 3 are in the raised position, as may be seen in FIG. 1.

The length of the opening 15 is determined as a function of the maximum diameter of the lens 18 and the shape of the box-section 3, and the opening is preferably fairly long to guarantee that the lens 18 abuts at least against the edges 19 laterally delimiting the opening when the lens is in place in the packaging 1 and the box-sections 3 are in the raised position.

Each box-section 3 further includes four locating tongues 20, 21 projecting from the edge 17 delimiting the opening 15 opposite the bottom panel 2. They are articulated about a scoring line 22 adjoining said edge 17.

The tongues 20, 21 are rectangular, and their length extends the full width of the opening 15.

It is convenient to distinguish the two central tongues 20 of each box-section 3 situated on respective opposite sides of a median axis and the two lateral tongues 21 framing the central tongues and extending along the edges 19 delimiting the opening 15 laterally.

Be this as it may, the four locating tongues 20, 21 of each box-section 3 are juxtaposed to each other and adapted to occupy the whole of the section of the opening 15 when they are disposed in the plane of the internal lateral panel 13.

The central tongues 20 and the lateral tongues 21 are unattached along their longer sides 23 and along their side 24 coinciding with the edge 16 delimiting the opening 15 adjoining the bottom panel 2, and they are attached to the internal lateral panel 13 only by virtue of their attachment 22 to the edge 17 delimiting the opening 15 on the side opposite the bottom panel 2.

Apart from the scoring lines 22 attaching them to the bottom panel 2, the tongues 20, 21 each comprise three other transverse scoring lines 25 along their length and dividing each tongue 20, 21 into four approximately equal portions.

The overall result is to provide for each box-section 3 four tongues 20, 21 freely mobile about an axis 22 coinciding with the edge 17 delimiting the opening 15 on the side opposite the bottom panel 2, this movement enabling the free end 26 of each tongue 20, 21 to assume a position on one side or the other of the plane of the internal lateral panel 13.

It will be noted that this movement induces elastic deformation of the locating tongue 20, 21 at the level of the scoring line 22 attaching it to the internal lateral panel 13, as a function of the elastic properties of the sheet material used to make the internal lateral panel 13 or the tongue 20, 21 (which material is cardboard in the present example).

Similarly, the tongues 20, 21 are adapted to deform elastically about each of the scoring lines 25 disposed along their length.

The flaps 4, 5 are disposed on respective opposite sides of two opposite edges 27, 28 of the bottom panel 2, each extending along a scoring line 29, 30, and they are therefore adjacent the box-sections 3, which occupy the other two opposite edges of the bottom panel 2.

Figure 9:
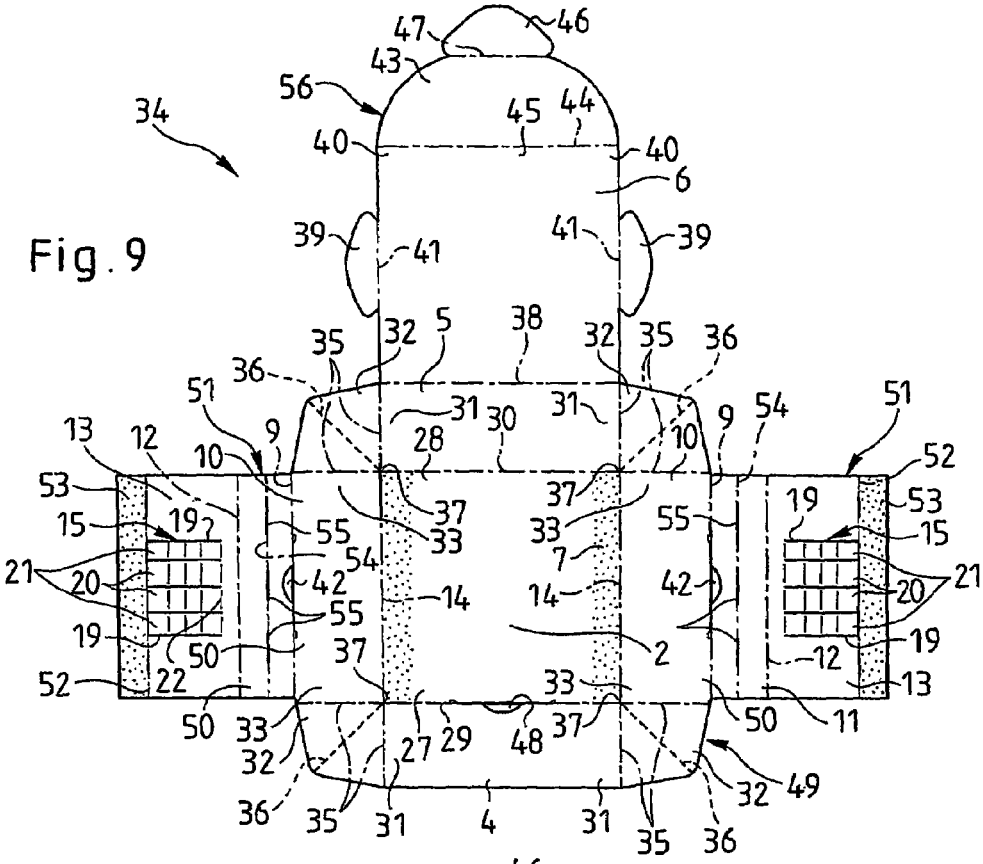
FIG. 9 is a top view of the flat blank from which the FIG. 1 packaging is formed by joining together the shaded portions.

As can be seen in FIG. 9, the bottom panel 2 is therefore extended from each of its edges 7, 27, 28 by four panels 4, 5, 10, forming a star shape given that the flaps 4, 5 are rectangular in shape and substantially identical to the external lateral panels 10.

Like the box-sections 3, or to be more precise like the external lateral panels 10, the flaps 4, 5 are mobile between a folded down position, in which the flap 4, 5 is coplanar with the bottom panel 2 (FIGS. 3, 7 and 10), and a raised position, in which the flap 4, 5 upstands substantially perpendicularly to the bottom panel 2 (FIG. 2).

As a result of this, when the flaps 4, 5 and the box-sections 3 are in the raised position, the flaps 4, 5 are positioned against the ends of the triangular sections 8 of the box-sections 3, so that the flaps 4, 5 and the external lateral panels 10 form the sides of a box of which the bottom panel 2 forms the bottom (see FIG. 2).

In the raised position, the shorter sides 31 of the flaps 4, 5 and the external lateral panels 10 coincide in pairs to form the edges of the box.

To facilitate bringing them into coincidence in this way, four gussets 32 form the junction between each edge 31 of the flaps and the adjacent edge 33 of the external lateral panel 10. In FIG. 9, representing the blank 34 of the packaging 1, the external lateral panels 10 and the flaps 4, 5 are in the plane of the bottom panel 2. In this figure, each gusset 32 is seen as a panel connecting the flaps 4, 5 and the external lateral panel 10, to which it is joined by two scoring lines 35, one of which is in line with the scoring line 29, 30 connecting the flap 4, 5 to the bottom panel 2 and the other of which is in line with the scoring line 14 connecting the external lateral panel 10 to the bottom panel 2.

Finally, the gusset 32 is completed by a central scoring line 36 extending from the corresponding corner 37 of the bottom panel 2 towards the end of the gusset 32 at an angle of 45°. As the box-sections 3 and the flaps 4, 5 are moved to the raised position, the gussets 32 fold inwards (FIG. 1) and guarantee that when the flaps 4, 5 are held against the box-sections 3 the latter are immobilized in the raised position.

The packaging 1 for an eyeglass lens 18 further includes a closure panel 6 with identical dimensions to those of the bottom panel 2, attached by a scoring line 38 to the free end of the flap 5, so that the closure panel 6 forms a lid, parallel to the bottom panel 2, for the box formed by the box-section 3 and the flaps 4, 5 in the raised position.

Means are provided for holding the closure panel 6 when exercising its lid function. In the present example those means comprise two attachment tongues 39 projecting from the closure panel 6, to be more precise from its two opposite edges 40 that are perpendicular to the scoring line 38 connecting it to the flap 5. Each attachment tongue 39 is delimited by a scoring line 41 in line with the edge 40 of the closure panel 6 and the tongues are adapted to cooperate with two notches 42 each formed in one of the intermediate panels 11.

There is also provided a fold-down panel 43 projecting beyond a scoring line 44 on the edge 45 of the closure panel 6 opposite the flap 5 and over a distance approximately equal to the width of the flaps 5, 6.

The fold-down panel 43 is itself extended on its side opposite the closure panel 6 by a third attachment tongue 46 extending along a scoring line 47 and adapted to cooperate with a notch 48 in the opposite flap 4, where it joins at 29 to the bottom panel 2.

Thus the packaging 1 can remain in the FIG. 2 position with the box-sections 3 and the flaps 4, 5 in the raised position, the closure panel 6 covering them, and the fold-down panel 43 against the corresponding flap 4. The three tongues 39, 46 inserted into their corresponding notches 42, 48 maintain the cohesion and the rigidity of the closed packaging 1.

The above components cooperate to protect and locate the lens 18 in all directions in space. It can be seen in FIGS. 1 and 2 that the lens 18 inside the packaging 1 is positioned along one of its diametral axes by the two lateral box-sections 3 and along a second of its diametral axes, perpendicular to the first, by the two flaps 4, 5, the bottom panel 2 and the closure panel 6 assuming positions on respective opposite sides of the lens 18, perpendicularly to the flaps 4, 5 and the box-sections 3.

Thus the packaging 1 is ready to be transported, stacked or simply manipulated without damage to the eyeglass lens 18.

FIG. 9 represents the blank 34 adapted to form the packaging 1 described above.

It includes a square central panel 49 in each corner of which two symmetrical cuts are made. A bottom panel 2, two external lateral panels 10, two flaps 4, 5 and four gussets 32 are delimited within this central panel 49.

The following scoring lines on the central panel 49 delimit the respective portions referred to:

- two scoring lines 14 connect the bottom panel 2 to the external lateral panels 10;
- two scoring lines 29, 30 connect the bottom panel 2 to the flaps 4, 5;
- four scoring lines 35 connect the external lateral panels 10 to the gussets 32; and
- four scoring lines 35 connect the flaps 4, 5 to the gussets 32.

A central scoring line 36 is formed on each gusset 32 by a row of perforations.

The blank 34 also includes, extending from the edge 50 of each external lateral panel 10 opposite the bottom panel 2, a box-section panel 51 attached by a scoring line 9 to said edge 50. Each of these box-section panels 51 includes first and second single scoring lines 12 and 52 successively delimiting an intermediate panel 11, an internal lateral panel 13 and a fixing panel 53.

A scoring line 54 on the intermediate panel 11 crosses the panel 11 longitudinally along a median line, this scoring line 54 having three notches 55 distributed along its length to encourage folding.

The internal lateral panel 13 receives a cut-out 15 corresponding to the opening described above and corresponding to cutting out three sides of a rectangle, one of which coincides with said second scoring line 52, as well as three cut-outs within said rectangle and perpendicular to the second scoring line 52, delimiting four locating tongues 20, 21 attached at one end to the internal lateral panel 13.

A single scoring line 22 is formed on each locating tongue 20, 21 where it is attached to the internal lateral panel 13 and three other transverse scoring lines 25 are distributed along the length of each tongue 20, 21.

Finally, the blank 34 includes a lid panel 56 attached by a scoring line 38 to the free edge of one of the flaps 5, this lid panel 56 including a scoring line 44 successively delimiting, from said free edge, a closure panel 6 and a fold-down panel 43, the lid panel 56 having an attachment tongue 39, 46 on each of its free edges, two facing attachment tongues 39 adapted to cooperate with the two notches 42 at the junction 9 of the external lateral panels 10 and the intermediate panels 11, and a third attachment tongue 46 adapted to cooperate with a notch 48 along the scoring line 29 joining the bottom panel 2 and the opposite flap 4.

The packaging 1 for an eyeglass lens 18 is simply formed from the blank 34 described by gluing each fixing flap 53 to the corresponding edge 7 of the bottom panel 2 (shaded area in FIG. 9) to juxtapose the scoring line 52 joining the internal lateral panel 13 to the fixing flaps 53 and the scoring line 14 joining the external lateral panel 10 to the bottom panel 2. The external lateral panel 10, the intermediate panel 11 and the internal lateral panel 13 therefore form a triangular section 8.

Figure 7:
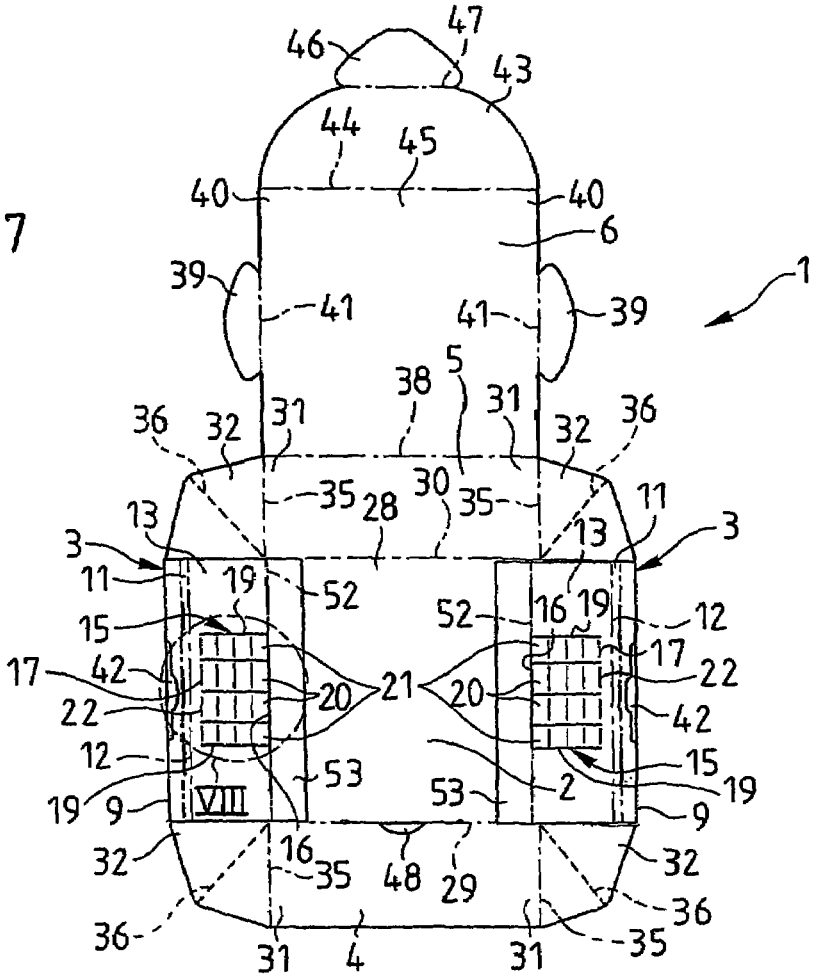
FIG. 7 is a top view similar to FIG. 3 with the lateral box-sections in a folded position and the eyeglass lens omitted.

Whereas FIG. 9 represents the blank 34 before gluing, FIG. 7 represents the blank 34 after the gluing operation has been carried out, the box-sections 3 being formed (they are seen from above in FIG. 9), a simple bending operation to move the box-sections 3 to the raised position yielding the packaging 1 shown in FIG. 1 ready for use.

Figure 10:
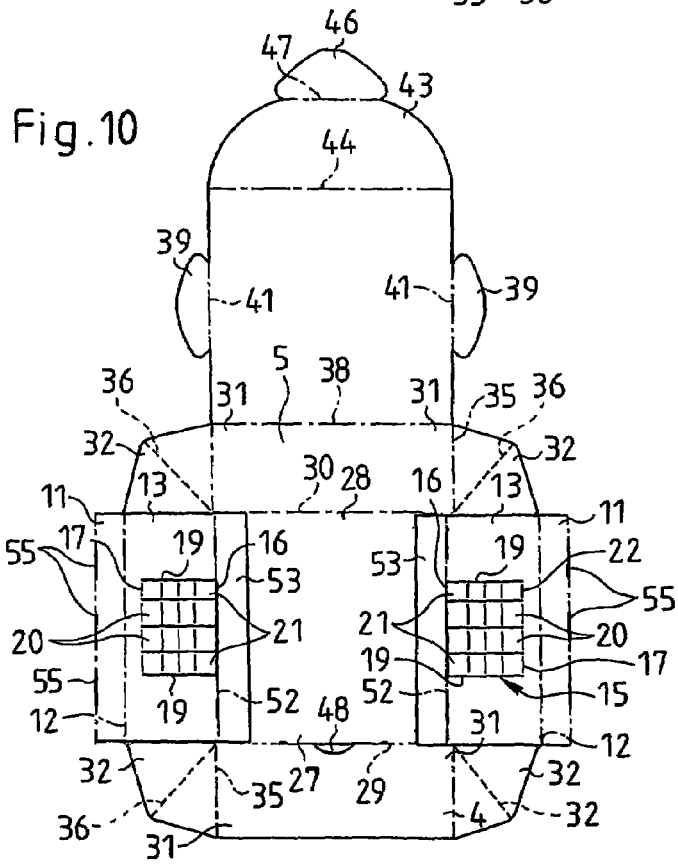
FIG. 10 is a view similar to FIG. 7 with the box-sections flattened out.

In practice, the manufacturer of the packaging 1 first cuts out the contour of the blank 34, after which the various notches and cut-outs are also formed, likewise the scoring lines, and the fixing flaps 53 are glued to the corresponding edge 7, holding the box-sections 3 folded along their scoring line 54, to obtain the flat blank shown in FIG. 10. The packaging 1 can therefore advantageously be shipped in packaging of its own in which the glued and flattened blanks 34 are stacked.

When the user receives one of these flat blanks, he first unfolds the intermediate panel 11 and moves the internal lateral panel 13 and the external lateral panel 10 away from each other, to make up the triangular sections 8 of the box-sections 3.

As shown in FIG. 7, the packaging 1 is adapted to a packaging method in which the lens 18 is placed on the bottom panel 2, after which the box-sections 3 are raised (see FIGS. 1 and 3), the flaps 4, 5 are folded, and the closure panel 6 positioned to yield the closed packaging shown in FIG. 2.

Figure 4:
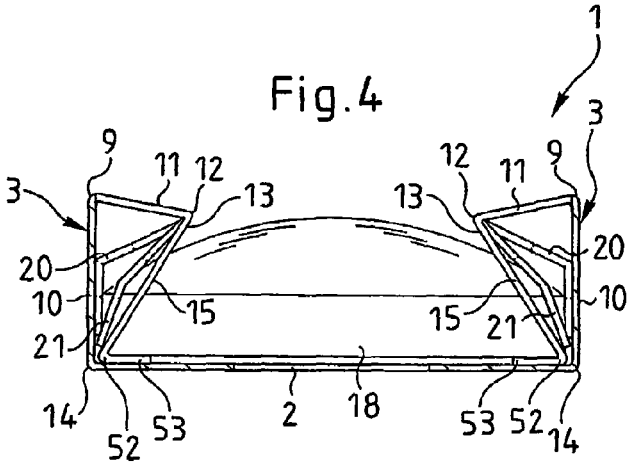
FIG. 4 is a view in elevation on the section plane IV-IV in FIG. 3, showing the cooperation of locating tongues with an eyeglass lens.
Figure 5:
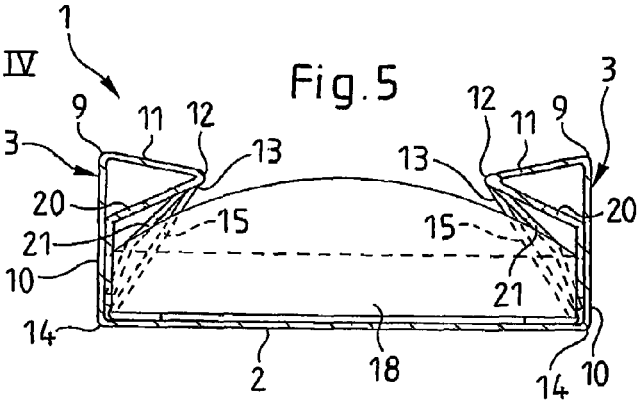
FIG. 5 is a view similar to FIG. 4, on the section plane V-V in FIG. 3.

For optimum location of an eyeglass lens 18, there is provided a packaging 1 with a square bottom panel 2 with a side length approximately equal to the diameter of the lens 18, which is therefore inserted into the openings 15 (FIG. 1), pushing the locating tongues 20, 21 back towards the interior of the box-sections 3 (FIGS. 4, 5 and 6).

In the FIG. 6 diagram the external lateral panel 10 of one of the box-sections 3 is shown as if it were transparent to render visible the behavior of the locating tongues 20, 21 upon insertion of the lens 18 into the openings 15. The curved contour of the lens 18 pushes the two central tongues 20 a greater distance towards the interior of the box-section 3 than the two lateral tongues 21, which is possible because the locating tongues 20, 21 are not attached at the level of the edge 16 of the opening 15 level with the bottom panel 2.

FIGS. 4 and 5 show the position of the tongues 20, 21 relative to the lens 18 as seen along the longitudinal axis of the box-sections 3. It is apparent that the central locating tongues 20 of the box-sections 3 locate the lens 18 along one of its diameters, adapting to the circumference and to the profile of the contour of the lens 18. The lateral locating tongues 21 also assume a position that adapts to the curvature of the lens 18 and exert a locating effect by virtue of the opposite pressure of each pair of corresponding facing tongues 20, 21 on each box-section 3. The lateral tongues 21 also retain the lens 18 in the event of movement in translation in the longitudinal direction of the box-sections 3, as their lateral edges abut laterally against the contour of the lens 18, where the latter enters more deeply in line with the central tongues 20.

The lens 18 is therefore located by the conjoint pressure of each pair of opposite central or lateral tongues 20, 21 on respective opposite sides of its diameter, and by virtue of the pressure of the four lateral tongues 21 forming a four-point cage adaptable to the contour of the lens 18 and preventing it from sliding laterally.

Apart from the positioning of the tongues 20, 21 referred to above, the function of the pressure applied to the lens 18 by the pairs of opposite tongues 20, 21 on each box-section 3 is conjointly assured by the elastic properties of the material of the tongues 20, 21 and by the configuration of the box-sections 3, with the triangular section 8 enabling the free end 26 of a tongue, when it is forced towards the interior of the box-section 3, to rise up along the internal wall of the external lateral panel 10 and where applicable to be braced against the latter (see FIGS. 4 and 5), the scoring lines 25 distributed along the tongue 20, 21 encouraging this behavior.

It will be noted that the packaging described here can also be used to package and locate a circular contour object other than an untrimmed eyeglass lens, for example some other type of optical lens.

The invention claimed is:

1. Packaging (1) for protecting and locating a circular contour object such as an eyeglass lens (18), the packaging including:

a bottom panel (2);

two box-sections (3), each including an external lateral panel (10) and an internal lateral panel (13), the internal lateral panel (13) including an opening (15) for at least partial insertion of the object, each box-section (3) being attached by an articulation (14) to the bottom panel (2) along a respective one of a first two opposite edges (7), each box-section (3) being configured to assume i) a first folded down position in which the external lateral panel (10) is in line with the bottom panel (2), and ii) a first raised position in which the external lateral panel (10) upstands relative to the bottom panel (2);

two flaps (4, 5) each attached by an articulation (29, 30) to the bottom panel (2) along a respective one of a second two opposite edges (27, 28) adjacent to the box-sections (3), each flap (4, 5) being configured to assume a second folded down position in which the flap is in line with the bottom panel (2), and a second raised position in which the flap (4, 5) upstands relative to the bottom panel (2) against longitudinal ends of the box-sections (3); and means for maintaining the box-sections (3) in the first raised position and the flaps (4, 5) in the second raised position, wherein, for each box-section (3), said external lateral panel (10) has a first end of said external lateral panel connected by an articulation (14) to the bottom panel (2), and a second end of said external lateral panel connected by an articulation (9) to a first end of an intermediate panel (11), wherein the intermediate panel (11) also includes a second end connected by an articulation (12) to a first end of said internal lateral panel (13), wherein the internal lateral panel (13) also includes a second end connected by an articulation (52) to the bottom panel (2) along and adjoining the articulation (14) between the first end of the external lateral panel (10) and the bottom panel (2), and wherein at least two locating tongues (20, 21) are disposed in the opening (15) and attached to the internal lateral panel (13) only by an end opposite the bottom panel (2), said locating tongues being juxtaposed to each other.

2. Packaging according to claim 1, wherein the bottom panel (2), the two box-sections (3), the two flaps (4, 5), and the means for maintaining the box-sections (3) are made in one piece.

3. Packaging according to claim 1, wherein the bottom panel (2) is square.

4. Packaging according to claim 1, wherein four locating tongues (20, 21) are disposed in each opening (15) in the internal lateral panels (13), each locating tongue (20, 21) being independent of the others and attached to the bottom panel (2) at one end.

5. Packaging according to claim 1, wherein the locating tongues (20, 21) each include at least one transverse scoring line (25) over a length of the tongue.

6. Packaging according to claim 1, wherein each box-section (3) is formed in one piece with the bottom panel (2) by a rectangular panel connected by a first scoring line (14) to the one of the first two opposite edges (7) of the bottom panel (2), said rectangular panel including a second scoring line (9) delimiting the external lateral panel (10), a third scoring line (12) delimiting the intermediate panel (11), a fourth scoring line (52) delimiting the internal lateral panel (13), and said rectangular panel extending beyond the fourth scoring line (52) by way of a fixing flap (53) fastened to the bottom panel (2) such that the fourth scoring line (52) is juxtaposed to the first scoring line (14).

7. Packaging according to claim 6, wherein the fixing flap (53) is glued to the bottom panel (2).

8. Packaging according to claim 1, wherein the intermediate panel (11) includes a longitudinal scoring line (54).

9. Packaging according to claim 1, wherein a width of the external lateral panel (10) is substantially equal to a width of the internal lateral panel (13).

10. Packaging according to claim 8, wherein the width of the external lateral panel (10) is substantially equal to the width of the internal lateral panel (13), and said longitudinal scoring line (54) is disposed substantially along a longitudinal median line of the intermediate panel (11).

11. Packaging according to claim 1, wherein the means for holding the box-sections (3) in the first raised position and the flaps (4, 5) in the second raised position include i) means (32) associated with the flaps (4, 5) and with the box-sections (3) to hold the box-sections (3) in the first raised position when the flaps (4, 5) are in the second raised position, and ii) means (6, 43, 46) for holding the flaps (4, 5) facing each other against the box-sections (3).

12. Packaging according to claim 1, wherein the means for holding the box-sections (3) in the first raised position and the flaps (4, 5) in the second raised position include a closure panel (6) articulated to a free edge of a first of the two flaps (5), the closure panel (6) including attachment means (39, 46) configured to attach to the box-sections (3) and to a second of the two flaps (4) such that the closure panel (6) assumes a closure position, wherein the closure panel (6), in the closure position, is parallel to the bottom panel (2) and positioned against i) the box-sections (3) and ii) a free edge of the second flap (4) when the box-sections (3) are in the first raised position and the flaps (4, 5) are in the second raised position.

13. Packaging according to claim 12, wherein the closure panel (6) includes, beyond a scoring line (44) and starting from an end of the closure panel (6) opposite the first flap (5) to which the closure panel (6) is articulated, a fold-down panel (43) configured to be superposed on the second flap (4) when the closure panel (6) is in the closure position.

14. Packaging according to claim 12, wherein said attachment means is comprised of attachment tongues (39, 46) projecting from edges of the closure panel (6), the box-sections (3) and the second flap (4) including notches (42, 48) configured to cooperate with the attachment tongues (39, 46).

15. Packaging according to claim 1, wherein the flaps (4, 5) are each attached to the longitudinal ends of the box-sections (3) by two gussets (32).

16. Sheet material packaging blank (34), comprising:

a bottom panel (2);

two external lateral panels (10), each external lateral panel connected by a respective one of first scoring lines (14) to a respective one of a first two opposite edges (7) of the bottom panel (2);

two flaps (4, 5), each flap connected by a respective one of second scoring lines (29, 30) to a respective one of a second two opposite edges (27, 28) of the bottom panel (2);

two intermediate panels (11), each intermediate panel connected by a respective one of a third scoring lines (9) to a respective one of the first two opposite edges of the bottom panel (2) of the two external lateral panels (10);

two internal lateral panels (13), each internal lateral panel connected by a respective one of a fourth scoring lines (12) to a respective one of said intermediate panels (11) at an edge of the intermediate panel opposite the external lateral panel (10), each internal lateral panel (13) being extended, in a direction away from the intermediate panel (11), by a fixing flap (53), the internal lateral panels (13) further including a cut-out (15) delimiting at least two tongues (20, 21) juxtaposed to each other and attached to the rest of the panel (13) only by a first end (22) of each tongue (20, 21) opposite the bottom panel (2); and a closure panel (6), with dimensions substantially equal to dimensions of the bottom panel (2) and connected by a scoring line (38) to an edge of a first of the two flaps (5) opposite the bottom panel (2).

17. Packaging blank according to claim 16, wherein the closure panel (6) further includes a fold-down panel (43) connected by a scoring line (44) to an edge (45) opposite the first flap (5).

18. Packaging blank according to claim 16, further including attachment tongues (39, 49) connected by fifth scoring lines (41, 47) to free edges of the closure panel (6).

19. Packaging blank according to claim 16, wherein a width of the external lateral panel (10) and a width of the internal lateral panel (13) are substantially equal.

20. Packaging blank according to claim 16, wherein ends of the external lateral panels (10) adjacent the bottom panel (2), and ends of the flaps (4, 5) adjacent the bottom panel (2), are connected in pairs by a gusset (32).

21. Packaging blank according to claim 16, wherein widths of each of the flaps (4, 5) and widths of each of the external lateral panels (10) are substantially equal.

22. A method of packaging and positioning a circular contour object (18), comprising the steps of:

using the packaging (1) according to claim 1; and selecting a combination of packaging and an object to be packaged such that the bottom panel (2) of the packaging (1) is a square, wherein a side length of the square is substantially equal to a diameter of the object (18).

* * * * *

UNITED STATES PATENT AND TRADEMARK OFFICE

CERTIFICATE OF CORRECTION

PATENT NO. : 7,604,119 B2
APPLICATION NO. : 10/535429
DATED : October 20, 2009
INVENTOR(S) : Schott et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 929 days.

Signed and Sealed this

Fifth Day of October, 2010

David J. Kappos

David J. Kappos
*Director of the United States Patent and Trademark Office*